US010091865B1

(12) United States Patent
Brockschmidt, Jr.

(10) Patent No.: US 10,091,865 B1
(45) Date of Patent: Oct. 2, 2018

(54) SYSTEMS AND METHODS FOR EXTENDING A LIFESPAN OF AN EXCIMER LAMP

(71) Applicant: THE BOEING COMPANY, Chicago, IL (US)

(72) Inventor: Arthur E. Brockschmidt, Jr., Renton, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/810,414

(22) Filed: Nov. 13, 2017

(51) Int. Cl.

| | |
|---|---|
| ***H05B 41/00*** | (2006.01) |
| ***H05B 41/39*** | (2006.01) |
| ***H01J 61/06*** | (2006.01) |
| ***H01J 61/56*** | (2006.01) |
| ***H01J 61/12*** | (2006.01) |

(52) U.S. Cl.
CPC ..... *H05B 41/39* (2013.01); *H01J 61/06* (2013.01); *H01J 61/12* (2013.01); *H01J 61/56* (2013.01)

(58) Field of Classification Search
CPC ..... H01L 2924/0002; H01L 2924/00; H01L 27/14618; H01L 27/14632; H01L 27/14645; H01L 27/14687; H01L 27/14692; H01L 2924/1433; H01L 2924/19041; H01L 2924/19042; H01L 2924/19043; H01L 2924/30105
See application file for complete search history.

(56) References Cited

U.S. PATENT DOCUMENTS 7,744,039 B2 * 6/2010 Miles ..... B64C 23/005 244/205
9,609,732 B2 * 3/2017 Smith ..... B82Y 10/00

OTHER PUBLICATIONS

Akashi et al., "Development of Streamers in Dielectric-Barrier-Discharge Excimer Lamp", IEEE Transactions on Plasma Science, vol. 36, No. 4, Aug. 2008. (2 pages).
Bonnin et al., "A High Voltage High Frequency Resonant Inverter for Supplying DBD Devices with Short Discharge Current Pulses", IEEE Transactions on Power Electronics, vol. 29, No. 8, Aug. 2014. (9 pages).
Cousineau et al., "Synthesized High-Frequency Thyristor for Dielectric Barrier Discharge Excimer Lamps", IEEE Transactions on Industrial Electronics, vol. 59, No. 4, Apr. 2012. (9 pages).
(Continued)

*Primary Examiner* — Monica C King
(74) *Attorney, Agent, or Firm* — Joseph M. Butscher; The Small Patent Law Group, LLC

(57) ABSTRACT

System and/or method generally relate to extending a lifespan of an excimer lamp. The system includes a ultra-violet (UV) light having a pair of dielectrics configured to separate electrodes. One of the electrodes includes a metal mesh. The system includes a power supply electrically coupled to the UV light and configured to deliver electrical power to the UV light. The system includes a temperature sensor operably coupled to the UV light. The temperature sensor is configured to generate a temperature signal indicative of a temperature of the UV light. The system includes at least one processor. The at least one processor is configured to determine a temperature of the UV light based on the temperature signal, and adjust the electrical power delivered to the UV light based on the temperature signal.

20 Claims, 3 Drawing Sheets

(56) References Cited

OTHER PUBLICATIONS

Diez et al., "Current-Mode Power Converter for Radiation Control in DBD Excimer Lamps", (2012) IEEE Transactions on Industrial Electronics, vol. 59 (n° 4). pp. 1912-1919. ISSN 0278-0046. (9 pages).
Diez et al., "Versatile Power Generator for the Parametric Study of DBD Excimer Lamps Supply and it's Optimization", 978-1-4799-8403-9/15/$31.00 © 2015 IEEE. (5 pages).
El-Deib et al., "Modeling of and Driver Design for a Dielectric Barrier Discharge Lamp" A thesis submitted to University of Toronto, 2010. (239 pages).
Florez et al., "DCM-Operated Series-Resonant Inverter for the Supply of DBD Excimer Lamps", IEEE Transactions on Industry Applications, vol. 50, No. 1, Jan./Feb. 2014. (8 pages).
Florez et al., "Impact of the Transformer in the Current Mode Supply of Dielectric Barrier Discharge Excimer Lamps", 978-1-4799-0272-9/13/$31.00 © 2013 IEEE. (6 pages).
Florez et al., "Optimizing the Operation of DBD Excilamps", (2016) IEEE Transactions on Plasma Science, vol. 44 (n° 7). pp. 1160-1168. ISSN 0093-3813 (10pages).
Florez et al., "Programmable Current Converter Synthesis for the Evaluation of UV Radiation of Excimer Lamps", 978-1-4244-6742-6/10/$26.00 © 2010 IEEE. (6 pages).
Florez et al., "Sources D'Alimentation Electrique Pour L'etude Et L'Utilisation Efficace Des Lampes Excimer DBD", Institut National Polytechnique de Toulouse (INP Toulouse), Jan. 20, 2014.
Florez et al., "Square-Shape Current-Mode Supply for Parametric Control of the DBD Excilamp Power", IEEE Transactionson Industrial Electronics, vol. 62, No. 3, Mar. 2015 (10 pages).
Jabbour et al., "Spectroscopic and Kinetic Behaviour of a Pure Krypton Dielectric Barrier Discharge", Published in: Gas Discharges and Their Applications, 2008. GD 2008. 17th International Conference on, Sep. 7-12, 2008, Cardiff, UK (4 pages).
Kogelschatz et al., "Dielectric-Barrier Discharges. Principle and Applications", Journal de Physique IV Colloque, 1997, 07 (C4), pp. C4-47-C4-66. (21 pages).
Meiber "Resonant Behaviour of Pulse Generators for the Efficient Drive of Optical Radiation Sources Based on Dielectric Barrier Discharges", KIT Scientific Publishing 2013, ISBN 978-3-7315-0083-4. (2016 pages).
Meisser et al., "Universal Resonant Topology for High Frequency Pulsed Operation of Dielectric Barrier Discharge Light Sources", Applied Power Electronics Conference and Exposition (APEC), 2011 Twenty-Sixth Annual IEEE, ISBN: 978-1-4244-8085-2, Mar. 11, 2011. (8 pages).
Oda et al., "Estimation of the Light Output Power and Efficiency of Xe Barrier Discharge Excimer Lamps Using a One-Dimensional Fluid Model for Various Voltage Waveforms", PII: S0022-3727(00)12330-7., J. Phys. D: Appl. Phys. 33 (2000) 1507-1513. (7 pages).
Wang et al., "Repetitive High-Voltage All-solid-state Marx Generator for Excimer DBD UV Sources", IEEE Transactions on Plasma Science, vol. 44, No. 10, Oct. 2016, (8 pages).

* cited by examiner

SYSTEMS AND METHODS FOR EXTENDING A LIFESPAN OF AN EXCIMER LAMP

FIELD

Embodiments of the present disclosure generally relate to excimer lamps, and, more particularly, to systems and methods of extending lifespans of excimer lamps.

BACKGROUND

Excimer lamps generate ultra-violet light, and may be utilized aboard an aircraft such as for an instrument panel of a flight deck and/or cockpit, external lights, water filtering, and/or the like. During operation of an excimer lamp, filaments and/or columns of conducting plasma of gas can form between dielectrics and electrodes. The filaments can attach at a set location within the excimer lamp and form voltage discharges, which heat the metal mesh and may form holes and/or cracks in the metal mesh. In this manner, the voltage discharges reduce a lifespan of the excimer lamp.

SUMMARY

A need exists for a system and/or method for adjusting a position of filaments during operation of the excimer lamp. Further, a need exists for a longer lasting excimer lamp.

With these needs in mind, certain embodiments of the present disclosure adjust a position of the filaments relative to dielectrics by adjusting electrical power delivered to the excimer lamp to extend a lifespan of the excimer lamp. The excimer lamp generates ultra-violet (UV) light. For example, the excimer lamp may represent a dielectric-barrier discharge (DBD) excimer lamp. The excimer lamp is electrically coupled to a power supply. The power supply provides electrical power to the excimer lamp to generate the UV light. The electrical power is provided by an electrical signal, which may represent alternating current at a set frequency and/or amplitude, a series of pulses having a set pulse width and/or amplitude, and/or the like.

The excimer lamp is operably coupled to a temperature sensor. The temperature sensor is configured to acquire temperature measurements that indicate a temperature of the excimer lamp. During operation of the excimer lamp, the filaments can form one or more hot spots between dielectrics and electrodes of the excimer lamp. The hot spots represent temperature increases, which are detected by the temperature sensor. For example, the temperature of the one or more hot spots may represent a temperature greater than 100 degrees Celsius. At least one processor receives the temperature measurements from the temperature sensor, and can adjust the power supply based on the temperature of the excimer lamp.

For example, the at least one processor adjusts the electrical signal delivered to the excimer lamp based on the temperature signal. The at least one processor is configured to adjust a frequency, a pulse width, an amplitude, and/or the like of the electrical signal delivered by the power supply to the excimer lamp. The adjustment of the electrical signal reduces electrical power received by the excimer lamp. The reduced electrical power shifts a position of the filament along the dielectrics of the excimer lamp.

In at least one embodiment, a permanent magnet and/or electromagnet generates a magnetic field such that the excimer lamp is within the magnetic field.

In at least one embodiment, concentric quartz tubes and are sealed with the excimer gas enclosed in the annular area between the quartz tubes. A metallic coating may include aluminum, silver, copper, and/or the like is applied to the inner tube which is one electrode of the lamp. The other electrode is a grid or transparent mesh on the external surface of the outer tube.

Optionally, an additional metallic coating is chemically deposited on at least one of the pair of dielectrics. The additional metallic coating may include aluminum, silver, copper, and/or the like. The additional metallic coating is configured to absorb heat generated by the filaments to protect the excimer lamp.

In at least one embodiment, the at least one processor is configured to adjust a position of the metal mesh relative to the excimer lamp. For example, the metal mesh is operably coupled to an actuator (e.g., electric motor, hydraulic actuator, pneumatic actuator, mechanical actuator) that adjusts a position of the metal mesh relative to the dielectrics during operation of the excimer lamp. The movement of the metal mesh adjusts a position of the filament relative to the dielectric.

Certain embodiment of the present disclosure provide a method for an excimer lamp. The method includes measuring a temperature of at least a portion of a ultra-violet (UV) light. The UV light having a pair of dielectrics configured to separate electrodes. One of the electrodes represents a metal mesh. The method includes adjusting a power supplied to the UV light based on the temperature.

BRIEF DESCRIPTION OF THE DRAWINGS

These and other features, aspects, and advantages of the present disclosure will become better understood when the following detailed description is read with reference to the accompanying drawings in which like numerals represent like parts throughout the drawings, wherein.

DETAILED DESCRIPTION

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Embodiments of the present disclosure provide an excimer lamp that produces ultra-violet (UV) light. The excimer lamp is monitored by at least one temperature sensor. The temperature sensor measures a temperature of the excimer lamp. For example, filaments create one or more hot spots, which may cause temperature spikes along a metal mesh of the excimer lamp. The hot spots are measured by the temperature sensor. The temperature spikes may reach a temperature over 100 degrees Celsius, which can affect the metal mesh and/or the excimer lamp. Based on the temperature, the electrical power delivered to the excimer lamps is reduced. For example, a frequency, a pulse width, an amplitude, and/or the like of the electrical power delivered to the excimer lamp is adjusted to reduce electrical power of the excimer lamp. The reduction of the electrical power shifts the filament with respect to the dielectrics within the excimer lamp. The shift of the filament adjusts a position of the hot spot, thereby extending the lifespan of the excimer lamp.

In at least one embodiment, a magnetic field can be overlaid on the excimer lamp concurrently with the reduction of the electrical power based on the temperature. The magnetic field additionally adjusts a position of the filament with the reduction of the electrical power.

Figure 1B:
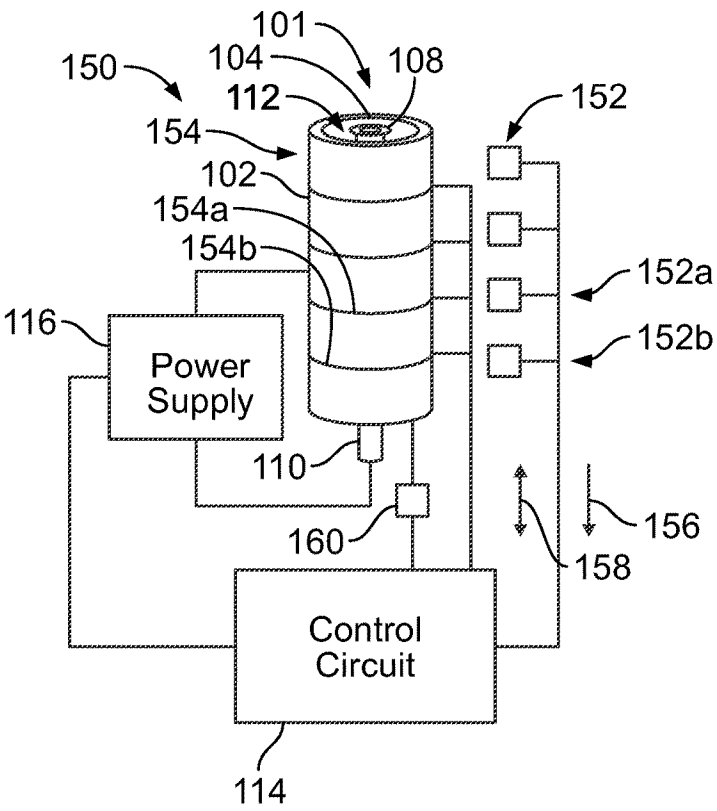
FIGS. 1A-B illustrate schematic views of an excimer lamp system, in accordance to an embodiment of the present disclosure.
Figure 1A:
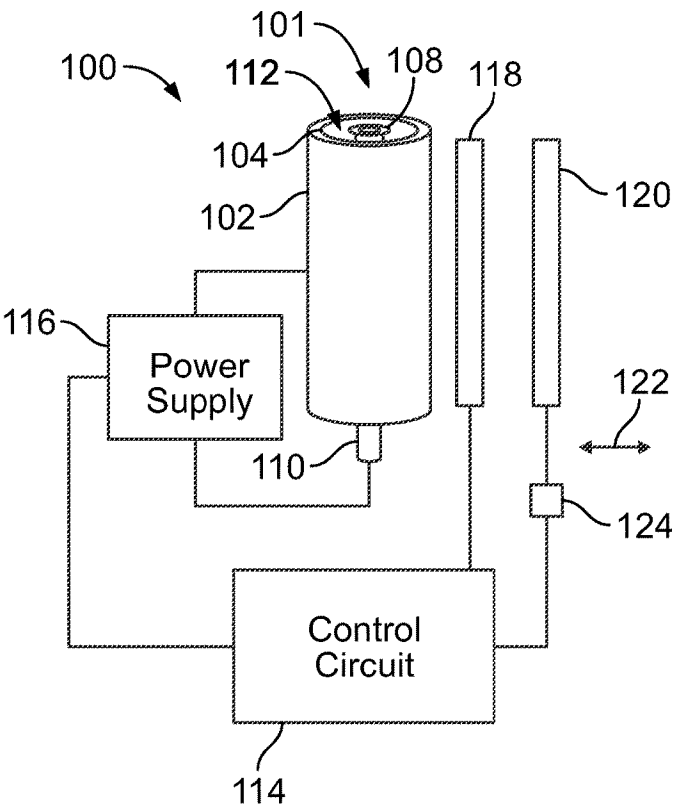

FIG. 1A illustrate schematic views of an excimer lamp system 100 in accordance to an embodiment of the present disclosure. In at least one embodiment the excimer lamp system 100 may have a planar geometry rather than the cylindrical geometry shown in FIG. 1A. The excimer lamp system 100 include an excimer lamp 101. The excimer lamp 101 is shown as a dielectric barrier discharge (DBD) excimer lamp. Additionally or alternatively, the excimer lamp 101 can represent a ultra-violet (UV) light. The UV light generated by the excimer lamp 101 can be utilized as a disinfecting lighting system. For example, the UV light can be utilized to disinfect water, air, structures, and/or the like of an aircraft.

The excimer lamp 101 is electrically coupled to a power supply 116. The power supply 116 is configured to provide electrical power to the excimer lamp 101 via an electrical signal. The electrical signal may represent, for example, an analog signal and/or digital signal. The electrical signal includes a set of electrical characteristics that define the electrical power provided to the excimer lamp 101. For example, the electrical characteristics include a frequency, an amplitude, a pulse width, and/or the like.

The power supply 116 is configured to provide the electrical power to ionize a gas 112 interposed between electrodes and/or dielectrics 104, 108 above a gas ignition threshold. The gas 112 may include Xeon-Chlorine, Krypton-Boron, Krypton-Chlorine, and/or the like. For example, the excimer lamp 100 is a 100 Watt bulb, indicative of the gas ignition threshold. The power supply 116 provides the electrical signal having a current peak of 50 mA, a voltage peak of 5 kV, and a frequency range of 50-200 kHz, which provides the electrical power of 100 Watts. The electrical power delivered by the power supply 116 ionizes the gas 112 to produce ultra-violet (UV) light. It may be noted that different electrical characteristics of the electrical signal may be utilized to provide electrical power to the excimer lamp 101.

The electrodes include a metal mesh 102 and a metallic rod 110 that are electrically conductive. For example, the metal mesh 102 and/or metallic rod 110 may include copper, gold, silver, and/or the like. The metal mesh 102 includes a dielectric 104 positioned within an internal circumference of the metal mesh 102. The metallic rod 110 includes a dielectric 108 along an outer circumference of the metallic rod 110. The dielectrics 104, 108 may include quartz, glass, ceramic, polymer, and/or the like. The dielectrics 104, 108 represent dielectric barriers for the electrodes (e.g., the metal mesh 102, metallic rod 110). For example, the dielectrics 104, 108 may represent glass that are overlaid or lined with a conductive foil, screen, or the metal mesh 102. Interposed between the dielectrics 104, 108 is the gas 112. For example, the gas 112 may represent a Krypton-Chlorine mixture.

Figure 2:
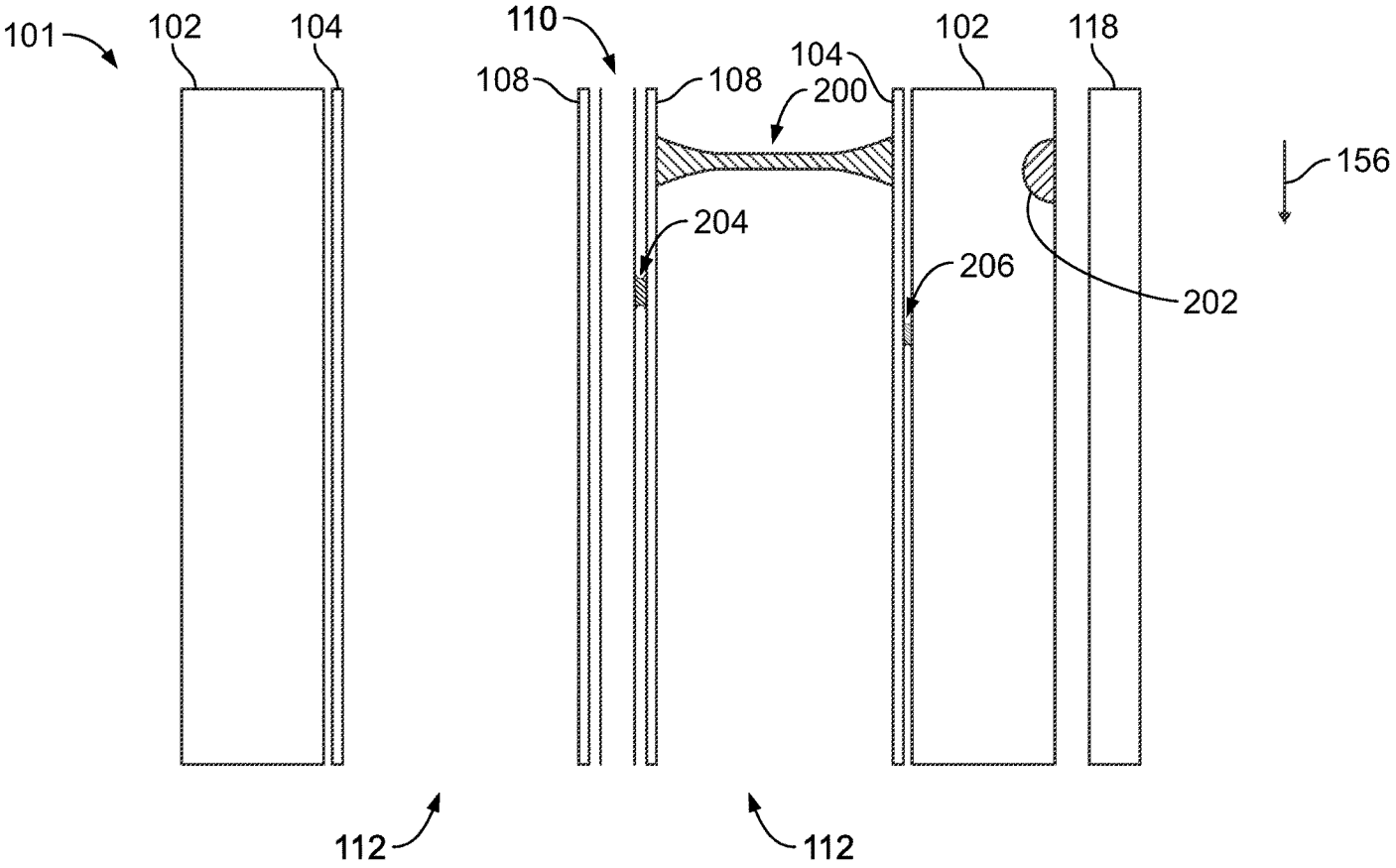
FIG. 2 illustrate a cross section of an excimer lamp, in accordance to an embodiment of the present disclosure.

FIG. 2 illustrate a cross section of the excimer lamp 101, in accordance to an embodiment of the present disclosure. During operation of the excimer lamp 101, a filament 200 may form between the dielectrics 104, 108. For example, the electrical signal provided by the power supply 116 builds a charge along a surface of the dielectrics 104, 108. The charge built along the dielectrics 104, 108 are discharged as the filament 200. The filament 200 can continually discharge at the same location. For example, the filament 200 increases the electric field within the gas 112 between the dielectrics 104, 108 at the location of the filament 200. As described herein, a control circuit 114 detects the filament 200 and adjusts a position of the filament relative to the dielectrics 104, 108.

The control circuit 114 (FIG. 1) is configured to control the operation of the excimer lamp system 100. The control circuit 114 may include at least one processor. Optionally, the control circuit 114 may include a central processing unit (CPU), one or more microprocessors, or any other electronic component capable of processing inputted data according to specific logical instructions. Optionally, the control circuit 114 may include and/or represent one or more hardware circuits or circuitry that include, are connected with, or that both include and are connected with one or more processors, controllers, and/or other hardware logic-based devices. Additionally or alternatively, the control circuit 114 may execute instructions stored on a tangible and non-transitory computer readable medium.

As used herein, the term "control circuit," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the control circuit 114 may be or include one or more processors that are configured to control operation of the excimer lamp 101, as described above.

The control circuit 114 is configured to execute a set of instructions that are stored in one or more data storage units or elements (such as one or more memories), in order to process data. For example, the control circuit 114 may include or be coupled to one or more memories. The data storage units may also store data or other information as desired or needed. The data storage units may be in the form of an information source or a physical memory element within a processing machine.

The set of instructions may include various commands that instruct the control circuit 114 to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program or a portion of a program. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the one or more control or processing units may represent processing circuitry such as one or more of a field programmable gate array (FPGA), application specific integrated circuit (ASIC), microprocessor(s), and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

The excimer lamp system 100 includes a temperature sensor 118. The temperature sensor 118 may represent an infrared thermometer or thermocouple. For example, the temperature sensor 118 generates an infrared signal that is emitted onto the metal mesh 102. The infrared signal may be configured to traverse along a length of the metal mesh 102. Additionally or alternatively, the infrared signal may extend the length of the metal mesh 102. The temperature sensor 118 generates a temperature signal indicative of the temperature of the metal mesh 102, which is received by the control circuit 114. For example, the temperature signal may represent an analog signal having a set frequency, amplitude, and/or the like that is indicative of a temperature of the metal mesh 102. In another example, the temperature signal may represent a digital signal having a frequency, a bit sequence, and/or the like that is indicative of a temperature of the metal mesh 102.

The temperature sensor 118 is operably coupled to the control circuit 114. For example, the control circuit 114 receives the temperature signal generated by the temperature sensor 118. The control circuit 114 monitors the temperature sensor 118 over time. For example, the control circuit 114 compares the temperature indicated by the temperature signal with a predetermined threshold.

For example, the predetermined threshold may represent a temperature value indicating the filament 200 (FIG. 2). The filament 200 forms a hot spot 202 on the metal mesh 102. The hot spot 202 represents a portion of the metal mesh 102 that has a temperature difference relative to the remaining metal mesh 102. The control circuit 114 compares the temperature at the hot spot 202 with the predetermined threshold. For example, the predetermined threshold may represent a temperature above 100 degrees Celsius. Responsive to the control circuit 114 identifying a temperature received from the temperature sensors 118 above the predetermined threshold, the control circuit 114 adjusts electrical characteristics of the electrical signal delivered by the power supply 116.

For example, the power supply 116 receives instructions from the control circuit 114 to reduce the electrical power delivered to the excimer lamp 101. The power supply 116 may adjust electrical characteristics of the electrical signal generated by the power supply 116. For example, based on the received instructions, the power supply 116 can reduce a frequency, a pulse width, amplitude, and/or the like of the electrical signal. The adjustment of the electrical signal delivered by the power supply 116 reduces the electrical power of the excimer lamp 101. The reduction of electrical power changes a location of the filament relative to the dielectrics 104, 108.

For example, the reduction of the electrical power reduces a charge built along the surface of the dielectrics 104, 108. The filament 200 is discharged along the surface of the dielectrics 104, 108. Responsive to the reduced charge built along the surface of the dielectrics 104, 108, the electric field within the gas 112 is shifted. The shift in the electric field based on the reduced electrical power moves the filament 200 between the dielectric 108 and the metallic rod 110 to form the filament 204. Additionally or alternatively, the shift in the electric field based on the reduced electrical power moves the filament 200 between the dielectric 104 and the metal mesh 102. Responsive to the reduced electrical power, the filaments 200, 204, 206 change a location with respect to the dielectrics 104, 108. The change in location prevents the filaments 200, 204, 206 from attaching at a set location within the excimer lamp 101. The change in location of the filaments 200, 204, 206 ensures the integrity of the metal mesh 102, and increases a lifespan of the excimer lamp 101.

Additionally or alternatively, the control circuit 114 (FIG. 1) is configured to position a magnetic fields, such that the excimer lamp 101 is within the magnetic field. For example, the control circuit 114 is operably coupled to a permanent magnet 120. Responsive to the temperature sensor 118 above the predetermined threshold, the control circuit 114 positions the permanent magnet 120 towards the excimer lamp 101. For example, the permanent magnet 120 may be operably coupled to an actuator 124. The actuator 124 represents an electric motor, hydraulic actuator, pneumatic actuator, mechanical actuator, and/or the like. The actuator 124 adjusts a position of the permanent magnet 120 along a direction of the arrow 122, towards the excimer lamp 101. The permanent magnet 120 generates the magnetic field. The adjustment of the permanent magnet 120 positions the magnetic field to be overlaid and/or within the excimer lamp 101. The magnetic field is utilized to change a location of the filament 200. For example, the magnetic field can be used concurrently with the reduced electrical power, which provides additional movement of the filament 200 relative to the dielectrics 104, 108 (e.g., forming the filaments 204, 206).

Optionally, the permanent magnet 120 is not operably coupled to the actuator 124. For example, the permanent magnet 120 is positioned within a predetermined distance (such as 5-10 centimeters) from the excimer lamp 101, such that the excimer lamp 101 is positioned within magnetic field.

FIG. 1B illustrate schematic views of an excimer lamp system 150, in accordance to an embodiment of the present disclosure. The excimer lamp system 150 includes a series of temperature sensors 154 along different positions of the metal mesh 102. The temperature sensors 154 are thermally coupled to the metal mesh 102. For example, heat energy (e.g., the hot spot 202) of the metal mesh 102 is received by the one or more temperature sensors 154. The temperature sensors 154 are operably coupled to the control circuit 114. The temperature sensors 154 may be or include one or more thermistors, thermocouples, an integrated circuit configured to measure a temperature, and/or the like. The temperature sensors 154 are configured to generate a temperature signal indicative of a temperature of the metal mesh 102.

The control circuit 114 monitors the temperature sensors 154 over time. Based on a position of the temperature sensors 154 relative to the metal mesh 102, the control circuit 114 determines a position of the filament. For example, the control circuit 114 compares the temperature received from the temperature sensors with the predetermined threshold.

In at least one embodiment, the control circuit 114 identifies the temperature signal output from at least one of the temperature sensor 154*a* is above the predetermined threshold. Based on the temperature being above the predetermined threshold, the control circuit 114 adjusts the electrical signal generated by the power supply 116. The power supply 116 reduces the electrical power by adjusting the electrical characteristics (e.g., a frequency, a pulse width, an amplitude) of the electrical signal delivered to the excimer lamp 101. The adjustment of the electrical signal delivered by the power supply 116 changes a location of the filament 200 with respect to the dielectrics 104, 108.

As the filaments 200, 204, 206 change locations, the control circuit 114 can detect changes in the position of the filaments 200, 204, 206. For example, the control circuit 114 determines the temperature detected by the temperature sensor 154*b* is above the predetermined threshold. The control circuit 114 then determines that the position of the filament 200 has moved along a direction of an arrow 156. Optionally, the control circuit 114 may instruct the power supply 116 to further reduce the electrical power to the excimer lamp 101 responsive to no movement of the filament. For example, the control circuit 114 instructs the power supply 116 to reduce the electrical power delivered to the excimer lamp 101 based on the temperature of the temperature sensor 154 is above the predetermined threshold. Responsive to the reduction of the electrical power, the control circuit 114 monitors continually monitors the temperature sensors 154. The control circuit 114 identifies the temperature sensor 154*a* includes a temperature above the predetermined threshold. Based on the temperature sensor 154*a* remaining above the predetermined threshold, the control circuit 114 determines that the filament has not changes position. The control circuit 114 instructs the power supply 116 to further reduce the electrical power to the excimer lamp 101. For example, the power supply 116 reduced the frequency of the electrical signal from 200 kHz to 190 kHz. The control circuit 114 instructs the power supply 116 to further reduce the electrical power delivered to the excimer lamp 101 from 190 kHz to 180 kHz. The control circuit 114 monitors the temperature sensors 208 to identify a shift of position of the filament. For example, the control circuit 114 determines that the temperature sensor 154*b* measures a temperature above the predetermined threshold. Based on the change of the temperature sensor 154*b*, the control circuit 114 determines that the filament 200 has shifted position within the excimer lamp 101.

Additionally or alternatively, the control circuit 114 is configured to generate magnetic fields onto the excimer lamp 101. For example, the control circuit 114 is operably coupled to a plurality of electromagnets and/or coils 152. Responsive to the temperature sensor 154*a* above the predetermined threshold, the control circuit 114 activates one or more of the electromagnets 152. For example, the control circuit 114 generates an electric current to the one or more electromagnets 152 concurrently with the reduction of the electrical power delivered by the power supply 116. The electric current is utilized to generate a magnetic field onto the excimer lamp 101.

Optionally, the control circuit 114 activates a portion of the electromagnets 152 based on the temperature sensor 154 detecting the filament. For example, the control circuit 114 identifies the temperature sensor 154*a* as a position of the filament, and activates the electromagnets 152*a-b*. The magnetic fields generated by the electromagnets 152*a-b* adjusts a position of the filament concurrently with the reduction in the electrical power delivered by the power supply 116.

Additionally or alternatively, the metal mesh 102 is operably coupled to an actuator 160. The actuator 160 represents an electric motor, hydraulic actuator, pneumatic actuator, mechanical actuator, and/or the like. The actuator 160 adjusts a position of the metal mesh 102 along directions of an arrow 158. For example, responsive to a detection by the control circuit 114 of the filament 200, the control circuit 114 instructs the actuator 160 to adjust a position of the metal mesh 102. The position of the metal mesh 102 can be adjusted continuously along the arrow 158. As the position of the metal mesh 102 is adjusted, a position of the filament 200 with respect to the dielectric 104, and continually changes and does not attach to a single location.

Figure 3:
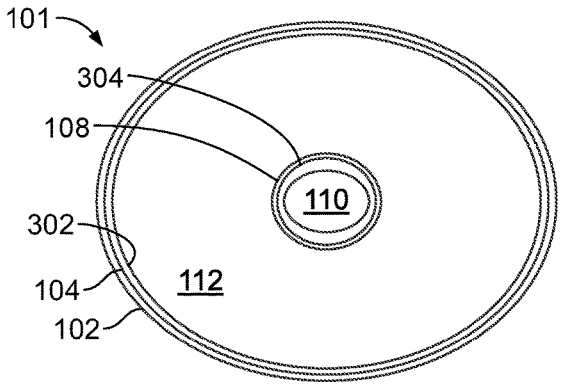
FIG. 3 illustrates a cross section of an excimer lamp, in accordance to an embodiment of the present disclosure.

Additionally or alternatively, the dielectric 108 may be coated with a metallic layer by chemical or vacuum deposition. FIG. 3 illustrates a cross section of the excimer lamp 101, in accordance to an embodiment of the present disclosure. The cross section includes a metallic layer 304 configured to absorb or spread heat generated by the filament 200 and to eliminate any air gaps between 110 and 108 which could produce partial discharges that can produce hot spots. For example, the additional metallic layer 304 can include aluminum, copper, silver, and/or the like. The additional metallic layer 304 absorb the heat from the hot spot 202 generated by the filament 200. The additional metallic layer 304 reduces a possibility of a hot spot 202 affecting the dielectric 108. For example, separation and/or air pockets between the 110 electrode and dielectric 108 form regions that have high impedance. The high impedance areas reduce a power efficiency of the excimer lamp 101 and can form localized partial discharges that cause hot spot and degrade dielectric 108. By vacuum or chemical deposition of the additional metallic layer 304 to the dielectric 108, a reduction in a likelihood that a separation and/or air pockets can be formed.

Figure 4:
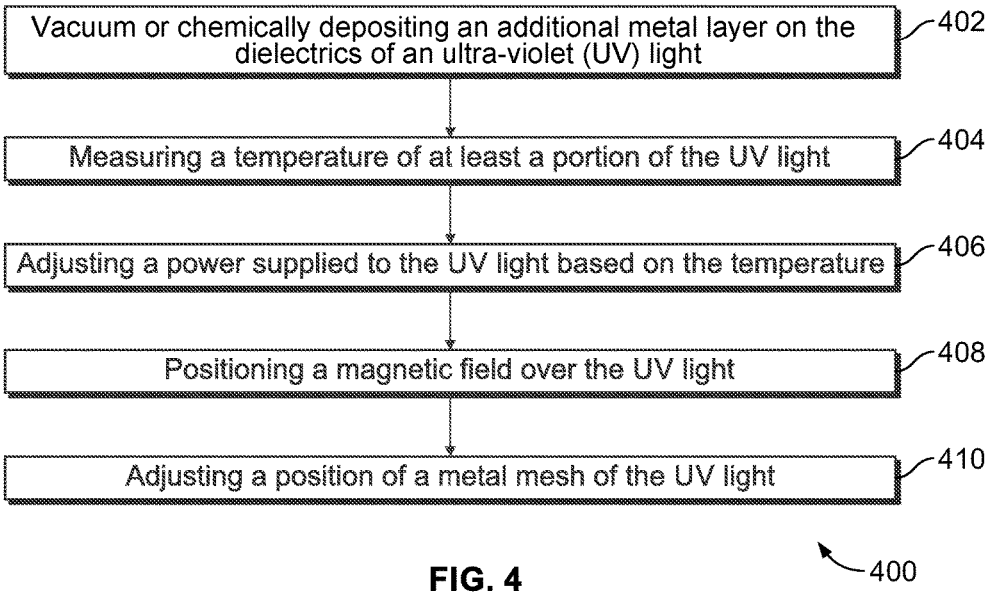
FIG. 4 illustrates a flow chart of a method to extend a life span of an excimer lamp, in accordance to an embodiment of the present disclosure.

FIG. 4 illustrates a flow chart of a method 400 to extend a life span of the excimer lamp 101, in accordance to an embodiment of the present disclosure. The method 400, for example, may employ or be performed by structures or aspects of various embodiments (e.g., systems and/or methods and/or process flows) discussed herein. In various embodiments, certain steps may be omitted or added, certain steps may be combined, certain steps may be performed concurrently, certain steps may be split into multiple steps, or certain steps may be performed in a different order.

Beginning at 402, an additional metal layer is vacuum or chemically depositing on the dielectrics 104, 108, of the UV light (e.g., excimer lamp 101). For example, the additional metal layer (e.g., the additional metallic layer 304 of FIG. 3) is configured to absorb heat generated by the filament. The additional metal layer is vacuum or chemically deposited to reduce a formation of separation and/or air pockets between the dielectrics 104, 108 and the additional metal layer. Optionally, the method 300 may not include 402.

At 404, a temperature is measured for at least a portion of the UV light and/or the excimer lamp 101. In connection with FIG. 1A, the temperature sensor 118 measures a temperature of the metal mesh 102 of the excimer lamp 101. The temperature sensor 118 generates a temperature signal indicative of the temperature of the metal mesh 102, which is received by the control circuit 114.

At 406, a power supplied to the UV light is adjusted based on the temperature. In connection with FIG. 1A, the temperature sensor 118 is operably coupled to the control circuit 114. The control circuit 114 receives the temperature signal generated by the temperature sensor 154 indicative of a temperature of the excimer lamp 101. The control circuit 114 compares the temperature indicated by the temperature signal with a predetermined threshold. For example, the predetermined threshold may represent a temperature value indicating the filament 200 and/or hot spot 202 is occurring between the dielectrics 104, 108 and the metal mesh 102, metallic rod 110. Responsive to the control circuit 114 identifying a temperature received from the temperature sensors 118 is above the predetermined threshold, the control circuit 114 instructs the power supply 116 to adjust the electrical power delivered to the excimer lamp 101. The power supply 116 may adjust electrical characteristics of the electrical signal generated by the power supply 116. For example, based on the received instructions, the power supply 116 can reduce a frequency, a pulse width, an amplitude, a pulse width, and/or the like of the electrical signal. The reduction of electrical power changes a location of the filament 200 relative to the dielectrics 104, 108.

At 408, a magnetic field is positioned over the UV light. In connection with FIG. 1A, the control circuit 114 is operably coupled to the permanent magnet 120. Responsive to the temperature sensor 118 above the predetermined threshold, the control circuit 114 positions the permanent magnet 120 towards the excimer lamp 101. For example, the permanent magnet 120 may be operably coupled to the actuator 124. The actuator 124 represents an electric motor, hydraulic actuator, pneumatic actuator, mechanical actuator, and/or the like. The actuator 124 adjusts a position of the permanent magnet 120 along a direction of the arrow 122, towards the excimer lamp 101. The permanent magnet 120 generates a magnetic field. The control circuit 114 adjusts a position of the permanent magnet 120 such that the excimer lamp 101 is positioned within the magnetic field. The magnetic field is utilized to change a location of the filament 200. For example, the magnetic field can be used concurrently with the reduced electrical power, which provides additional movement of the filament 200 relative to the dielectrics 104, 108. Optionally, the permanent magnet 120 is not operably coupled to the actuator 124. For example, the permanent magnet 120 may be positioned within a predetermined distance (such as 5-10 centimeters) from the excimer lamp 101, such that the excimer lamp 101 is continually positioned within the magnetic field. Optionally, the method may not include 308.

At 410, a position of the metal mesh 102 of the UV light is adjusted. In connection with FIG. 1B, the metal mesh 102 is operably coupled to an actuator 160. The actuator 160 adjusts a position of the metal mesh 102 along directions of the arrow 158. For example, responsive to a detection by the control circuit 114 of a filament, the control circuit 114 instructs the actuator 160 to adjust a position of the metal mesh 102. Optionally, the method may not include 310.

As described above, embodiments of the present disclosure provide systems and methods for adjusting electrical power and/or providing a magnetic field to adjust a position of a filament in a dielectric-barrier discharge (DBD) excimer lamp. The adjustment in the position of the filament mitigates hot spots that may otherwise affect the DBD excimer lamp It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An excimer lamp system, comprising:

an ultra-violet (UV) light having a pair of dielectrics configured to separate electrodes, wherein one of the electrodes includes a metal mesh;

a power supply electrically coupled to the UV light and configured to deliver an electrical signal to the UV light;

a temperature sensor operably coupled to the UV light, wherein the temperature sensor is configured to generate a temperature signal indicative of a temperature of the UV light; and at least one processor configured to:

determine a temperature of the UV light based on the temperature signal; and adjust the electrical signal delivered to the UV light based on the temperature signal, which reduces electrical power received by the UV light.

2. The system of claim 1, wherein the at least one processor is configured to reduce the electrical power when the temperature signal is above 100 degrees Celsius.

3. The system of claim 1, further comprising a permanent magnet or an electromagnet having a magnetic field that is overlaid on the UV light.

4. The system of claim 1, wherein the at least one processor is configured to identify movement of a filament.

5. The system of claim 1, further comprising an electromagnet configured to generate a magnetic field in relation to the UV light, wherein the at least one processor is configured to activate the electromagnet based on the change of the temperature signal.

6. The system of claim 1, wherein the at least one processor is configured to adjust at least one of a frequency, an amplitude, or a pulse width of the electrical signal.

7. The system of claim 1, wherein an additional metallic coating is chemically deposited on at least one of the pair of dielectrics.

8. The system of claim 1, further comprising an actuator operably coupled to the metal mesh, wherein the at least one processor is configured to adjust a position of the metal mesh over time.

9. A method comprising:

measuring a temperature of at least a portion of an ultra-violet (UV) light, wherein the UV light has a pair of dielectrics configured to separate electrodes, wherein one of the electrodes includes a metal mesh; and adjusting an electrical signal received by the UV light based on the temperature, which reduces electrical power received by the UV light.

10. The method of claim 9, wherein the adjusting operation is configured to reduce the electrical signal in response to the temperature being above 100 degrees Celsius.

11. The method of claim 9, further comprising generating a magnetic field such that the UV light is within the magnetic field.

12. The method of claim 11, wherein the generating operation comprises generally with at least one of a permanent magnet, or an electromagnet.

13. The method of claim 9, further comprising activating an electromagnet configured to generate a magnetic field on the UV light based on the temperature.

14. The method of claim 9, wherein the adjusting operation includes modifying at least one of a frequency, an amplitude, or a pulse width of the power supplied to the UV light.

15. The method of claim 9, further comprising chemically depositing an additional metallic coating to at least one of the pair of dielectrics.

16. The method of claim 9, further comprising adjusting a position of the metal mesh.

17. A system for adjusting a power to change a location of filaments of a dielectric barrier discharge excimer lamp, the system comprising:

a lighting system having a dielectric barrier discharge (DBD) excimer lamp;

a power supply configured to deliver electrical power to the DBD excimer lamp;

a temperature sensor configured to determine a temperature of the DBD excimer lamp;

at least one processor configured to reduce the electrical power delivered by the power supply based on the temperature of the DBD excimer lamp.

18. The system of claim 17, wherein the at least one processor is configured to adjust a position of the filament contacting a dielectric of the DBD excimer lamp.

19. The system of claim 17, wherein the at least one processor is configured to generate a magnetic field such that the DBD excimer lamp is positioned within the magnetic field.

20. The system of claim 17, wherein an additional metallic coating is chemically deposited on at least one of the dielectrics of the DBD excimer lamp.

* * * * *